US007926122B1

(12) United States Patent
Countryman

(10) Patent No.: US 7,926,122 B1
(45) Date of Patent: Apr. 19, 2011

(54) PANTS WITH EXTENDED ZIPPER

(76) Inventor: Virginia Countryman, Dalton, GA (US)

( * ) Notice: Subject to any disclaimer, the term of this patent is extended or adjusted under 35 U.S.C. 154(b) by 169 days.

(21) Appl. No.: 12/151,789

(22) Filed: May 9, 2008

Related U.S. Application Data

(60) Provisional application No. 60/928,888, filed on May 11, 2007.

(51) Int. Cl.
*A41D 1/06* (2006.01)
*A41D 13/02* (2006.01)

(52) U.S. Cl. ..... 2/227; 2/234

(58) Field of Classification Search ..... 2/78.2, 2/79, 219, 405, 408, 235, 227, 234
See application file for complete search history.

(56) References Cited

U.S. PATENT DOCUMENTS

| | | | | |
|---|---|---|---|---|
| 1,976,126 | A | 10/1934 | Hickerson | |
| 2,138,230 | A | 11/1938 | Friedman | |
| 2,521,767 | A | 9/1950 | Zecha | |
| D231,155 | S * | 4/1974 | Bowcot | D2/742 |
| 3,975,777 | A | 8/1976 | Roy | |
| 4,006,494 | A | 2/1977 | Knoppel | |
| 4,447,911 | A | 5/1984 | Marcellaro | |
| 4,578,828 | A | 4/1986 | Smith, Sr. et al. | |
| 4,604,761 | A | 8/1986 | Wright | |
| 4,987,610 | A | 1/1991 | Hunt | |
| 5,010,595 | A | 4/1991 | Stradley | |
| 5,560,042 | A | 10/1996 | Schlesner | |
| 5,642,526 | A | 7/1997 | Thompson | |
| 5,911,312 | A | 6/1999 | Holyfield | |
| 5,983,401 | A | 11/1999 | Ohara | |
| 6,035,448 | A | 3/2000 | Thomson | |
| 6,055,673 | A * | 5/2000 | McCormick | 2/227 |
| 6,115,838 | A | 9/2000 | Scholtis et al. | |
| 6,148,443 | A | 11/2000 | Maastricht | |
| 6,161,223 | A | 12/2000 | Andrews | |
| 6,243,878 | B1 * | 6/2001 | Khemka et al. | 2/227 |
| 6,260,209 | B1 | 7/2001 | St. Ange | |
| D503,513 | S | 4/2005 | McCarthy | |
| D506,303 | S | 6/2005 | Rocha | |
| 6,941,584 | B1 | 9/2005 | Matthews | |
| 2002/0040496 | A1 | 4/2002 | Blaire | |
| 2003/0024034 | A1 | 2/2003 | Hosogai | |
| 2004/0128731 | A1 | 7/2004 | Marty et al. | |
| 2004/0261156 | A1 | 12/2004 | Lewis et al. | |
| 2005/0091728 | A1 | 5/2005 | Rocha | |
| 2005/0246819 | A1 | 11/2005 | Tucker | |
| 2006/0107441 | A1 | 5/2006 | Houdroge | |
| 2006/0174399 | A1 | 8/2006 | Nikolayev et al. | |

* cited by examiner

*Primary Examiner* — Gary L Welch
*Assistant Examiner* — Amber R Anderson
(74) *Attorney, Agent, or Firm* — Chambliss, Bahner & Stophel, P.C.

(57) ABSTRACT

An article of clothing comprising a waistband adapted to extend around the user's waist. The waistband has a front area adapted to be worn on the front of the user and a rear area adapted to be worn on the rear of the user. A pair of leg members extend from the waistband, each of which is adapted to surround at least a portion of one of the user's legs and each of which has a distal end spaced apart from the waistband and an inseam extending between each distal end of the pair of leg members. The article also includes a short zipper extending between the front area of the waistband and a location near the inseam and an extended zipper extending between the pair of leg members from a location below the front area of the waistband to a location below the rear area of the waistband.

5 Claims, 6 Drawing Sheets

PANTS WITH EXTENDED ZIPPER

CROSS-REFERENCES TO RELATED APPLICATIONS/PATENTS

This application relates back to and claims priority from U.S. Provisional Application for Patent Ser. No. 60/928,888 dated May 11, 2007 and entitled "Pants With Extended Zipper."

FIELD OF THE INVENTION

The present invention relates generally to articles clothing adapted to worn on the lower portion of the user, and particularly to pants having an extended zipper.

BACKGROUND AND DESCRIPTION OF THE PRIOR ART

It is known to provide pants with a zipper extending from the front of the pants through the crotch to the rear of the pants. These conventional pants, however suffer from several disadvantages. For example, these conventional pants do not include both an extended zipper and a short zipper. Further, these conventional pants do not include legs that may be shortened to fit the inseam of the user without excessive fraying.

It would be desirable, therefore, if a pair of pants could be provided that would include both an extended zipper and a short zipper. It would also be desirable if such a pair of pants could be provided that would include legs that may be shortened to fit the inseam of the user without excessive fraying.

ADVANTAGES OF THE PREFERRED EMBODIMENTS OF THE INVENTION

Accordingly, it is an advantage of the preferred embodiments of the invention described herein to provide a pair of pants that includes both an extended zipper and a short zipper. It is also an advantage of the preferred embodiments of the invention to provide a pair of pants that includes legs that may be shortened to fit the inseam of the user with minimal fraying.

Additional advantages of the invention will become apparent from an examination of the drawings and the ensuing description.

Explanation of Technical Terms

As used herein, the term "pants" includes long pants, short pants, culottes, maternity pants, jumpsuits or any other article of clothing that may be worn on the lower portion of the user.

As used herein, the term "zipper" means any suitable device for detachably connecting an opening in a pair of pants as that term is defined above. The term "zipper" includes, without limitation, buttons, snaps, hooks, hook and loop fasteners, lacing and any other suitable device, mechanism, assembly or combination thereof adapted to open and close an opening in a pair of pants.

SUMMARY OF THE INVENTION

The invention comprises an article of clothing adapted to be worn on the lower portion of a user. The article of clothing comprises a waistband that is adapted to extend around the user in the area of the user's waist. The waistband has a front area adapted to be worn on the front of the user and a rear area adapted to be worn on the rear of the user. The article of clothing also includes a pair of leg members extending from the waistband. Each of the pair of leg members is adapted to surround at least a portion of one of the user's legs. In addition, each of the pair of leg members has a distal end that is spaced apart from the waistband and an inseam extending between each distal end of the pair of leg members. The article of clothing also includes a short zipper extending between a location in the front area of the waistband and a location near the inseam of the article of clothing and an extended zipper extending between the pair of leg members from a location below the front area of the waistband to a location below the rear area of the waistband.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
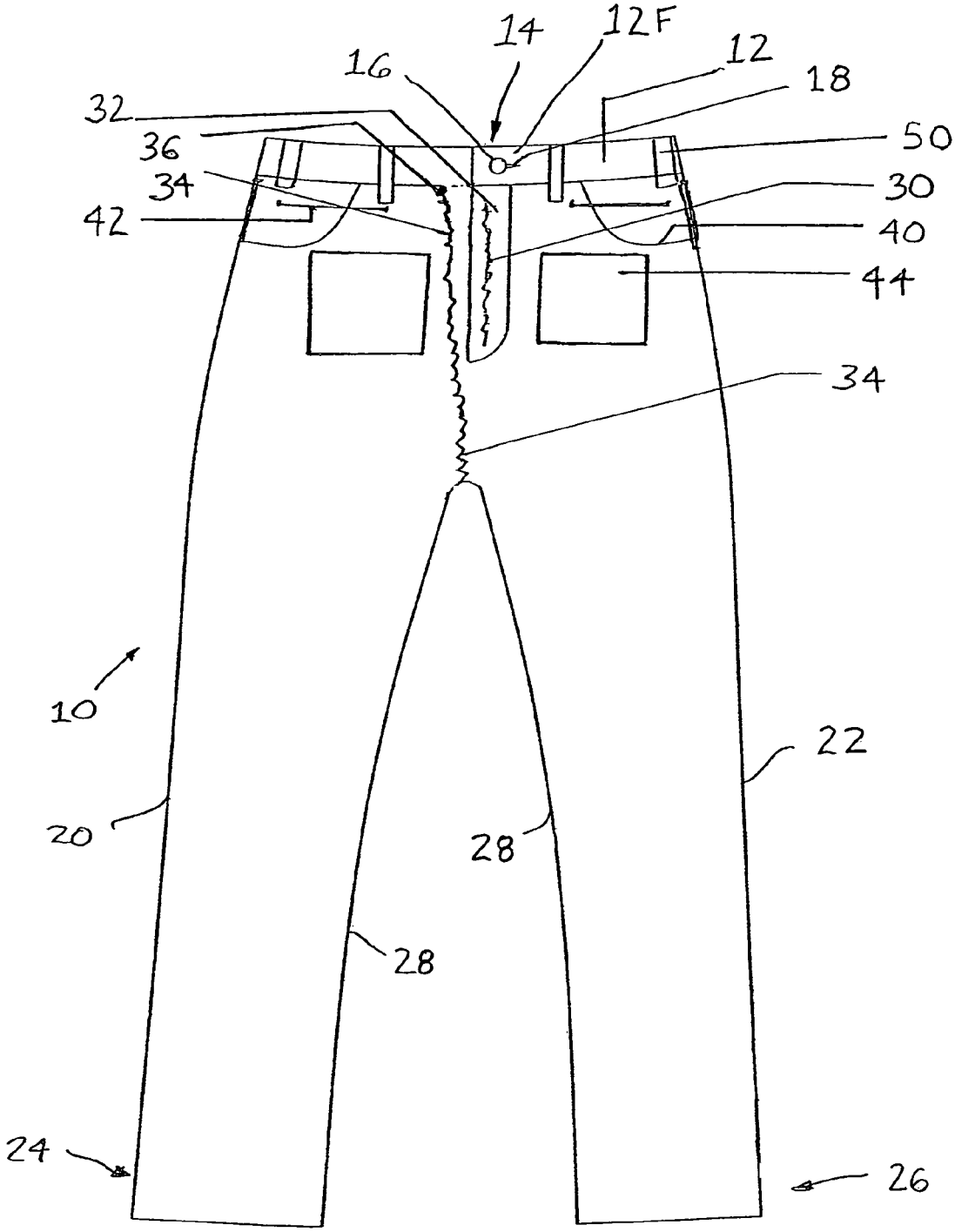
FIG. 1 is a front view of a preferred embodiment of the pants with an extended zipper in accordance with the present invention.

Referring now to the drawings, the preferred embodiments of the pants with an extended zipper in accordance with the present invention are illustrated by FIGS. 1 through 6. As shown in FIGS. 1-6, the preferred embodiments of the invention are articles of clothing adapted to be worn on the lower portion of a user such as pants, trousers, shorts, culottes, maternity pants, jumpsuits or any garment of any length that may be worn on the lower portion of the user's body. Further, the preferred embodiments of the invention may be worn by males or females of all ages and can be made of any natural or synthetic material or animal skin. The preferred embodiments of the invention permit the user to easily eliminate body waste in circumstances where a toilet is not available. The preferred embodiments of the invention also permit the user to easily eliminate body waste in circumstances where it is undesirable to make contact between the user's pants and the surface below the user's feet.

Referring now to FIG. 1, a front view of a preferred embodiment of the pants with an extended zipper in accordance with the present invention is illustrated. As shown in FIG. 1, the preferred pair of pants is designated generally by reference numeral 10. More particularly, preferred pants 10 includes waistband 12 that is adapted to extend around the user in the area of the user's waist. The preferred waistband 12 has a front area 12F adapted to be worn on the front of the user and a rear area 12R adapted to be worn on the rear of the user. The preferred waistband 12 includes an opening at 14 that is adapted to be detachably connected and a means for detachably connecting the opening such as button 16 and button hole 18. It is contemplated that the means for detachably connecting the opening in the waistband may include snaps, hooks, lace, hook and loop fasteners or any other suitable device. It is also contemplated within the scope of the invention that the waistband may extend continuously without an opening at 14 or any other location.

Still referring to FIG. 1, preferred pants 10 also include a pair of leg members 20 and 22 extending from waistband 12. Each of the preferred pair of leg members 20 and 22 are adapted to surround at least a portion of one of the user's legs. In addition, each of the preferred pair of leg members 20 and 22 has a distal end 24 and 26, respectively, that is spaced apart from the waistband 12 and inseam 28 extending between each distal end of the pair of leg members. It is contemplated within the scope of the invention that the pair of leg members may be of any suitable length and configuration.

Referring still to FIG. 1, the preferred pants 10 also include short zipper 30 concealed beneath flap 32 and an extended zipper 34. The preferred short zipper extends between a location in the front area of waistband 12 and a location near inseam 28 of the article of clothing. The preferred short zipper 30 extends upwardly toward 12 waistband and downwardly toward the crotch. The preferred short zipper 30, however, does not extend downwardly through the crotch. It is contemplated within the scope of the invention that the preferred short zipper may include any suitable device, mechanism, assembly or combination thereof adapted to open and close an opening in a pair of pants. For example, the preferred short zipper may include, without limitation, buttons, snaps, hooks, hook and loop fasteners, lacing and the like. It is also contemplated within the scope of the invention that preferred short zipper 30 may not be concealed beneath a flap.

Still referring to FIG. 1, the preferred extended zipper 34 extends between the pair of leg members 20 and 22 from a location below the front area of the waistband to a location below the rear area of the waistband. See also FIG. 2. Preferably, extended zipper 34 extends between the leg members through the crotch and is concealed by a flap or a front panel. Alternatively, the preferred extended zipper 34 may be sewn like an invisible zipper or any other type of zipper. The preferred extended zipper 34 may also be separated from the user by an interior flap or cover so as to avoid direct contact with the user. It is also contemplated that the extended zipper may be secured by a panel or lining attached to the interior of the pants. The preferred extended zipper 34 may be a one-way zipper or a two-way zipper. It is contemplated within the scope of the invention that the preferred extended zipper 34 may comprise more than one zipper. It is further contemplated within the scope of the invention that the preferred extended zipper 34 may include any suitable device, mechanism, assembly or combination thereof adapted to open and close an opening in a pair of pants. For example, the preferred extended zipper may include, without limitation, buttons, snaps, hooks, hook and loop fasteners, lacing and the like. In addition, it is contemplated within the scope of the invention that the preferred extended zipper may include snap 36 to secure the zipper and prevent unintended movement of the zipper. It is contemplated within the scope of the invention, however, that a hook, hook and loop fastener or any other securing mechanism may be provided at either or both ends of the extended zipper in order to secure the zipper and prevent unintended movement of the zipper.

Referring still to FIG. 1, the preferred pair of pants 10 also includes pockets that may be side pockets 40, slit pockets 42, patch pockets 44 or any combination thereof. It is contemplated within the scope of the invention that preferred pair of pants have fewer or more than four pockets, and that the pockets may be placed in any suitable location on the pants.

Figure 2:
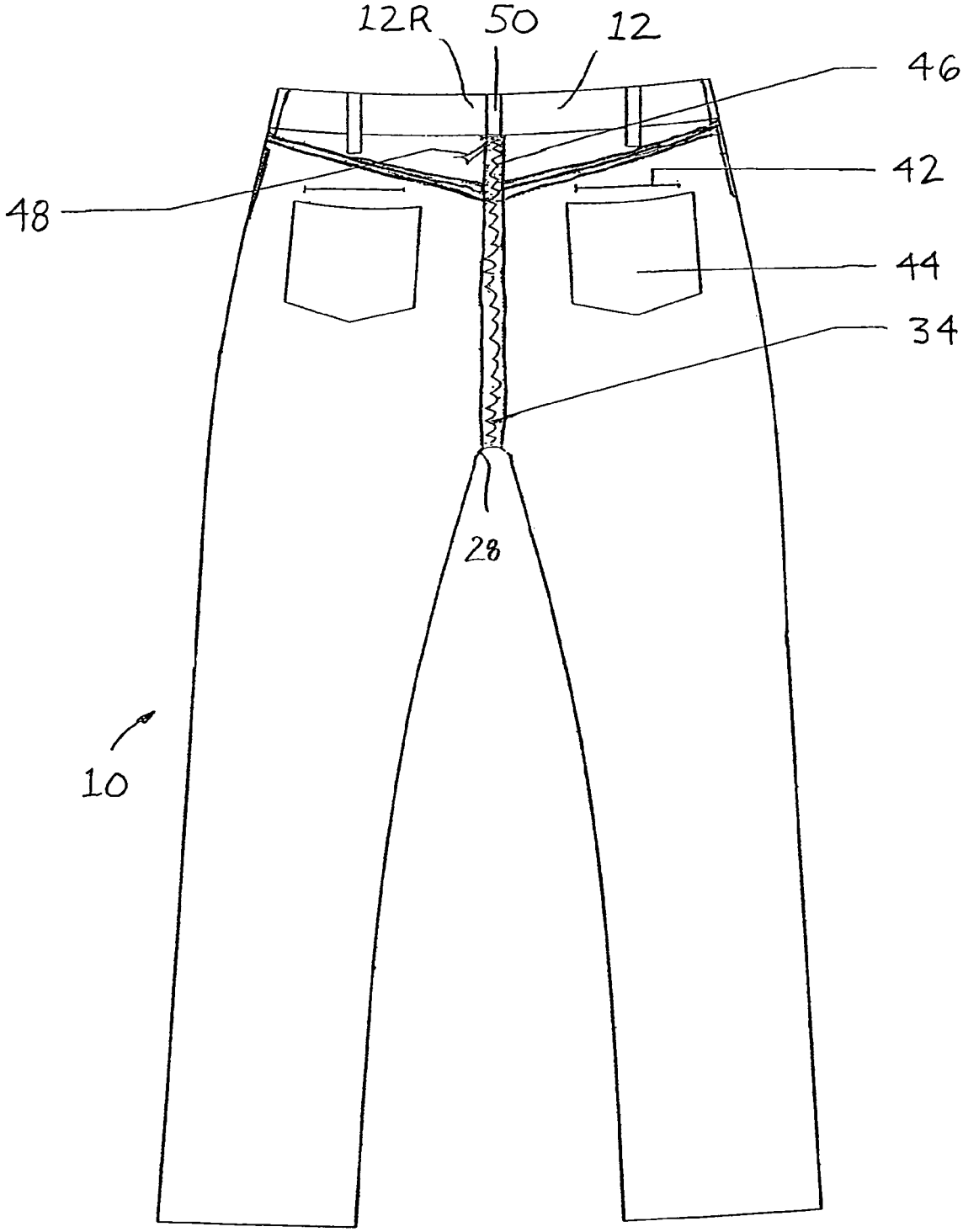
FIG. 2 is a rear view of the preferred embodiment of the pants with an extended zipper illustrated in FIG. 1.

Referring now to FIG. 2, a rear view of the preferred pair of pants 10 is illustrated. As shown in FIG. 2, the preferred extended zipper 34 extends through the user's crotch and inseam 28 to a location in the rear of the pants beneath waistband 12. As shown in FIG. 2, the preferred extended zipper 34 may be substantially concealed by flap 46 and include a tab or pull 48 for ease of use. Preferably, pull 48 is provided with hook and loop fastener or some other suitable means adapted to prevent unintended movement of the extended zipper. The preferred pair of pants 10 also include patch pockets 44 and slit pockets 42 on the rear of the pants. The preferred waistband 12 includes belt loops 50 placed at various locations, but it is contemplated within the scope of the invention that the waistband may not include belt loops. The preferred belt loops may include a belt loop that is aligned with extended zipper 34. It is also contemplated within the scope of the invention that preferred waistband 12 may include elastic portions which permit expansion and contraction of the waistband.

Figure 3:
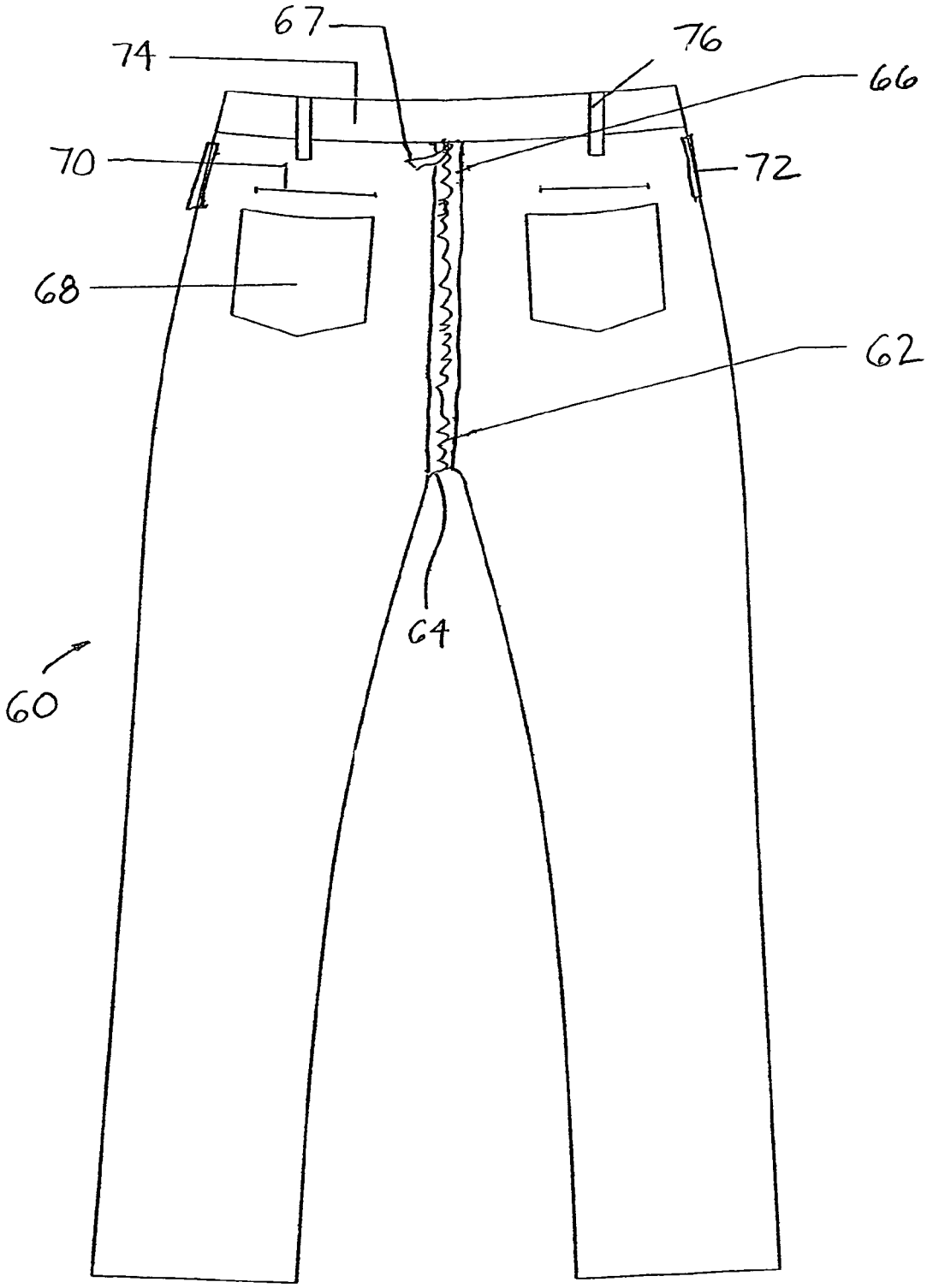
FIG. 3 is a front view of a first alternative embodiment of the pants with an extended zipper in accordance with the present invention.

Referring now to FIG. 3, a front view of an alternative embodiment of the pants with an extended zipper in accordance with the present invention is illustrated. As shown in FIG. 3, the preferred pair of pants is designated generally by reference numeral 60. Preferred pair of pants 60 includes extended zipper 62 which extends from a location in the front of the pants beneath the waistband through the user's crotch and inseam 64. Preferably, extended zipper 62 is concealed by flap 66 or sewn like an invisible zipper or any other type of zipper. The preferred extended zipper 62 may be a one-way zipper or a two-way zipper and may include pull 67. It is also contemplated within the scope of the invention that the preferred extended zipper 62 may comprise more than one zipper. It is further contemplated within the scope of the invention that the preferred extended zipper may include any suitable device, mechanism, assembly or combination thereof adapted to open and close an opening in a pair of pants. For example, the preferred extended zipper may include, without limitation, buttons, snaps, hook and loop fasteners, lacing and the like. The preferred pair of pants 60 also includes patch pockets 68, slit pockets 70, side seam pockets 72, waistband 74 and belt loops 76.

Figure 4:
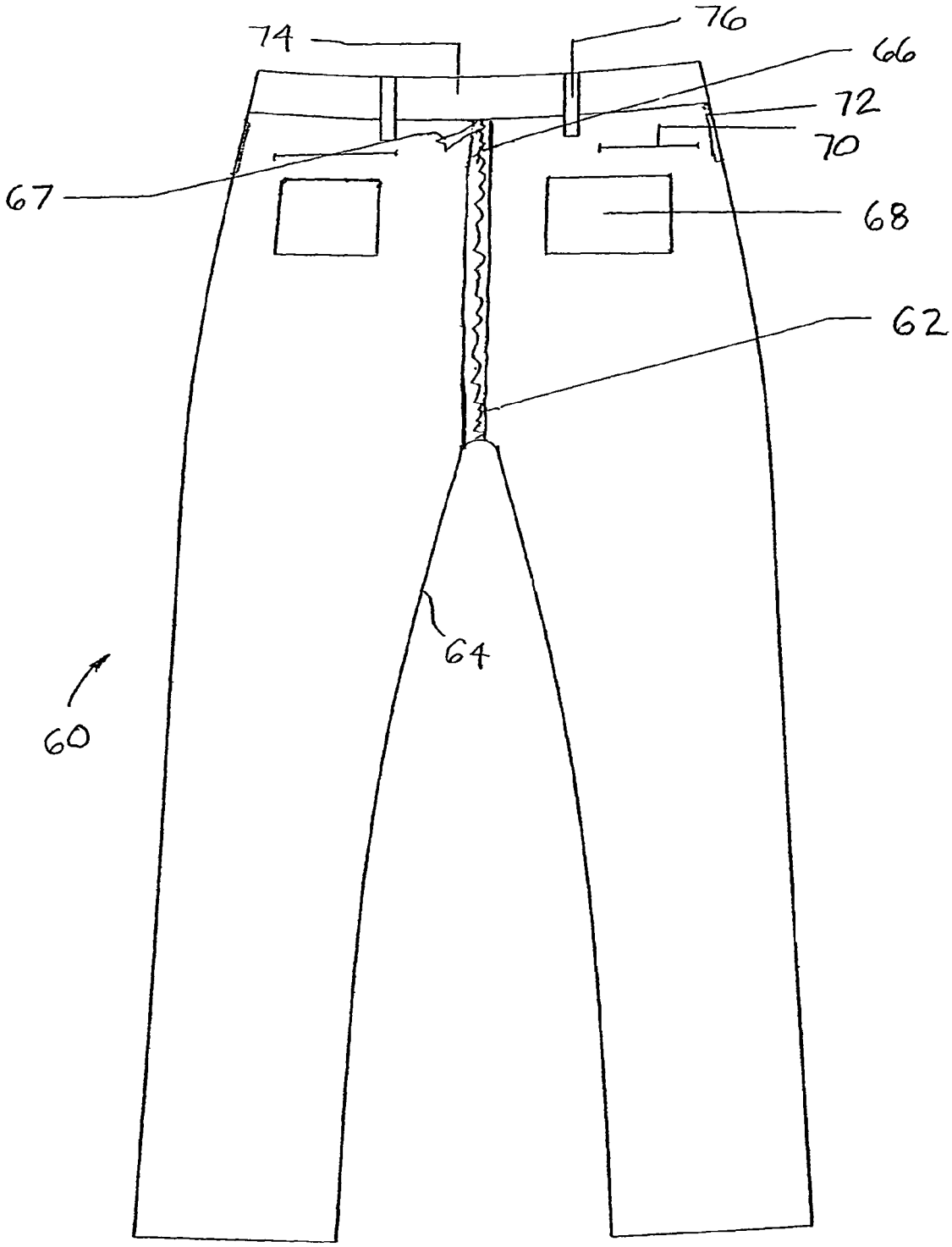
FIG. 4 is a rear view of the first alternative embodiment of the pants with an extended zipper shown in FIG. 3.

Referring now to FIG. 4, a rear view of the preferred pair of pants 60 is illustrated. As shown in FIG. 4, the preferred extended zipper 62 extends through the user's crotch and inseam 64 to a location in the rear of the pants beneath waistband 74. Patch pocket 68 and slit pocket 70 may be provided on the rear of preferred pants 60. It is contemplated within the scope of the invention that preferred pair of pants have fewer or more than ten pockets, and that the pockets may be placed in any suitable location on the pants. The preferred waistband 74 is elastic so as to permit expansion and contraction of the waistband. Further, the preferred waistband 74 is continuous and may be provided with belt loops 76.

Figure 5:
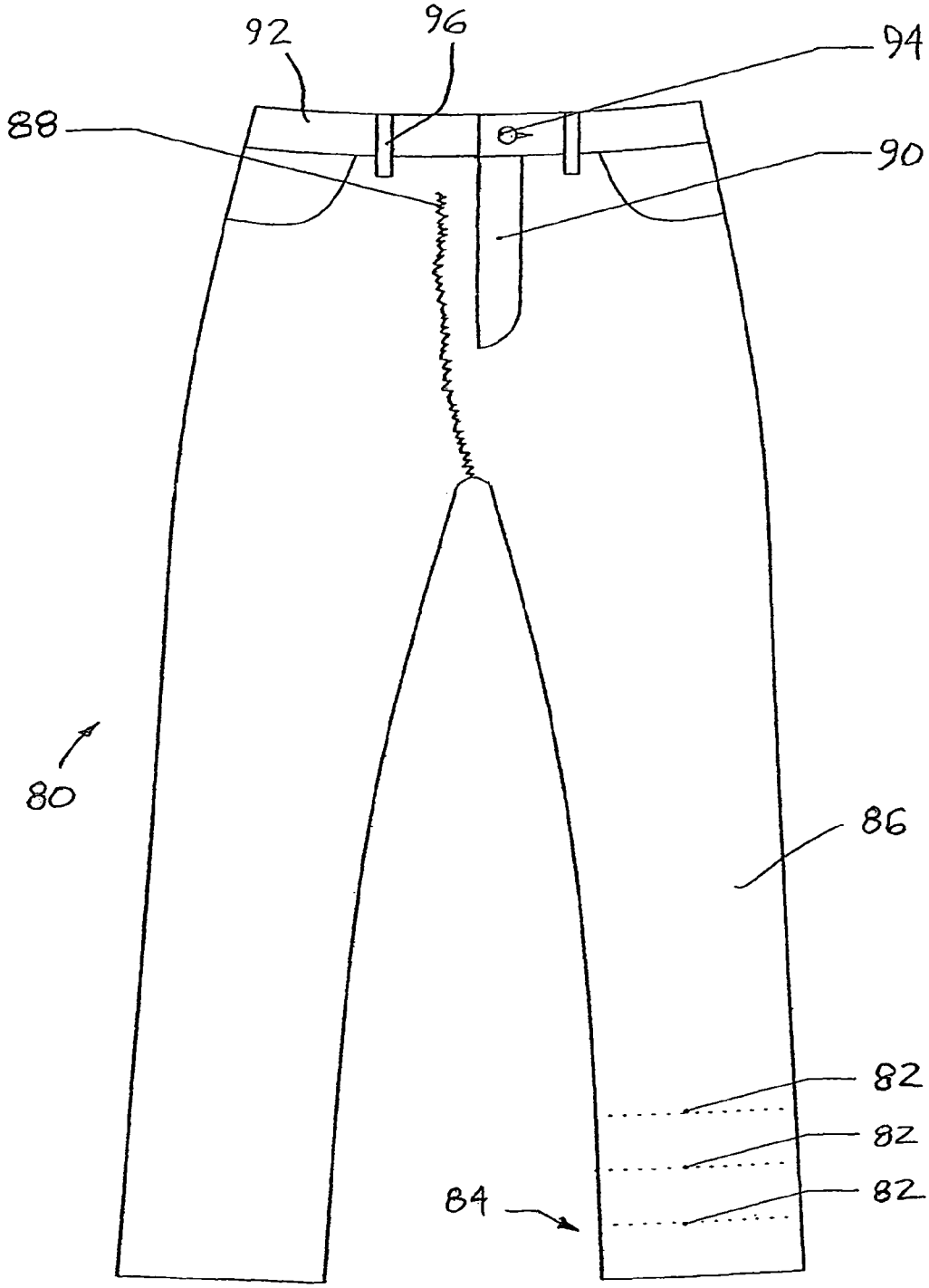
FIG. 5 is a front view of a second alternative embodiment of the pants with an extended zipper in accordance with the present invention.

Referring now to FIG. 5, a second alternative embodiment of the pants with an extended zipper is illustrated. As shown in FIG. 5, the preferred pair of pants is designated generally by reference numeral 80. Preferred pants 80 include stitching 82 around distal end 84 of leg member 86 at a plurality of locations. The preferred stitching 82 may be adapted to correspond with users having different physical characteristics such as height and weight. The preferred stitching 82 allows the pant leg to be cut with minimal fraying. Consequently, each pair of pants may be manufactured to have the same length, and each user may cut the pants to his or her desired length with minimal fraying. The preferred pair of pants 80 also includes extended zipper 88, a short zipper concealed by flap 90 and waistband 92 having button 94 and belt loops 96. In addition, preferred pair of pants 80 includes a lining adapted to protect the user from direct contact with extended zipper 88.

Figure 6:
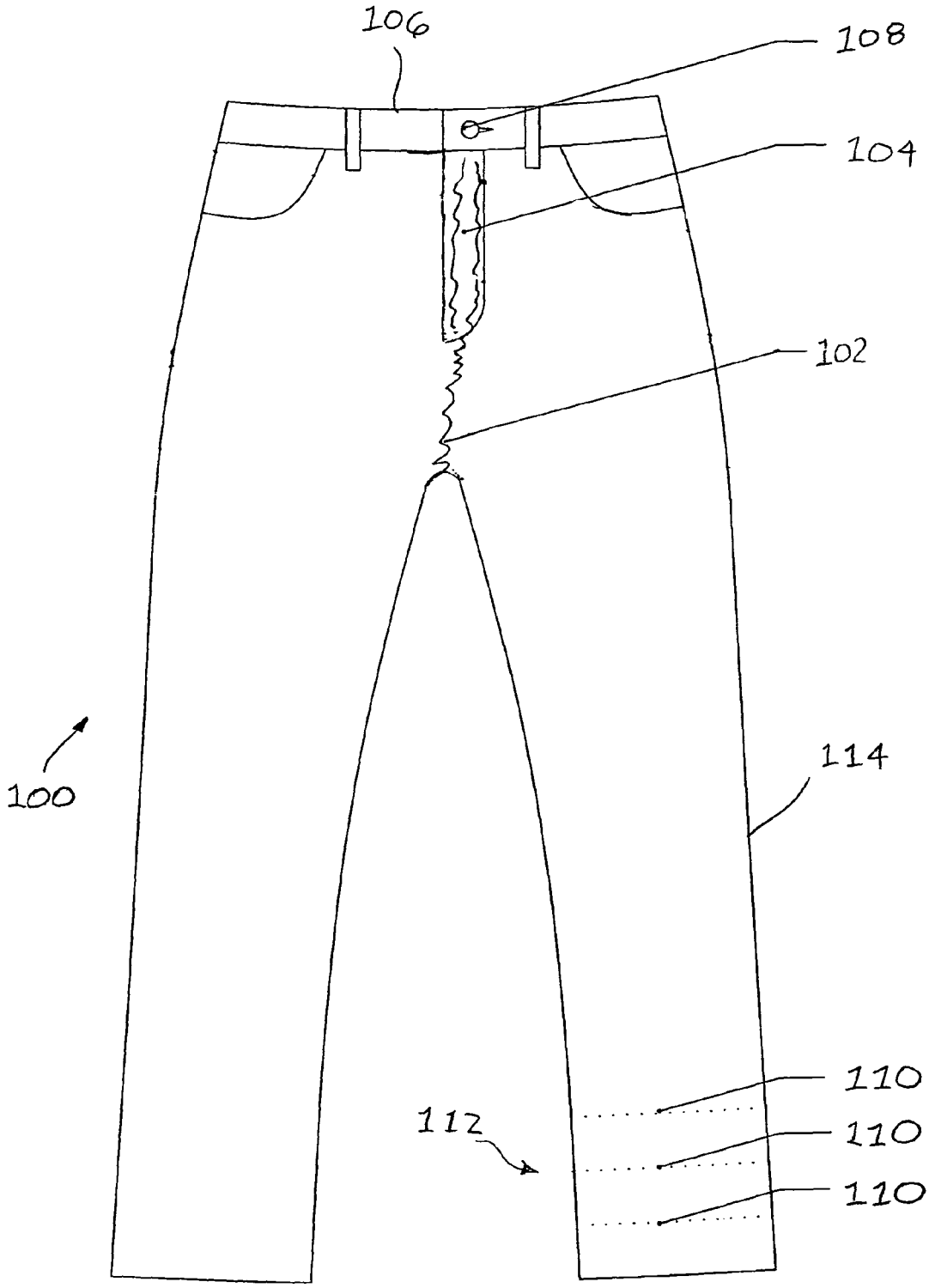
FIG. 6 is a front view of a third alternative embodiment of the pants with an extended zipper in accordance with the present invention.

Referring now to FIG. 6, a third alternative embodiment of the pants with an extended zipper is illustrated. As shown in FIG. 6, the preferred pair of pants is designated generally by reference numeral 100. Preferred pants 100 include extended zipper 102, a portion of which extends behind flap 104. In addition, the preferred flap 104 is detachably secured to the pants by a fastening means such as a hook and loop fastener, a snap, a button, a hook or any other suitable device. The preferred pair of pants 100 also includes waistband 106 having button 108 and stitching 110 at the distal end 112 of leg member 114.

In use, several advantages of the preferred embodiments of the invention are achieved. For example, the preferred pair of pants includes both a short zipper and an extended zipper. The preferred pair of pants also includes legs that may be shortened to fit the hem (pant leg length) of the user with minimal fraying. The preferred embodiments of the invention are adapted for use in connection with pants, trousers, shorts, culottes, maternity pants, jumpsuits or any garment of any length that may be worn on the lower portion of the user's body. Further, the preferred embodiments of the invention may be worn by males or females of all ages and can be made of any natural or synthetic material or animal skin. The preferred embodiments of the invention also permit the user to easily eliminate body waste in circumstances where a toilet is not available. The preferred embodiments of the invention are particularly useful to hikers, campers, ranchers, military personnel, handicapped individuals, pregnant women and the like and in severe weather conditions. The preferred embodiments of the invention also permit the user to easily eliminate body waste in circumstances where it is undesirable to make contact between the user's pants and the surface below the user's feet.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An article of clothing adapted to be worn on the lower portion of a user, said article of clothing comprising:

(a) a waistband, said waistband being adapted to extend around the user in the area of the user's waist and having a front area adapted to be worn on the front of the user and a rear area adapted to be worn on the rear of the user;

(b) a pair of leg members extending from the waistband, each of said pair of leg members being adapted to surround at least a portion of one of the user's legs and each of said pair of leg members having:

(1) a distal end, said distal end being spaced apart from the waistband; and (2) an inseam extending between each distal end of the pair of leg members;

(c) a short zipper, said short zipper extending between a location in the front area of the waistband and a location near the inseam of the article of clothing;

(d) an extended zipper, said extended zipper extending between the pair of leg members from a location adjacent to the rear area of the waistband to a location adjacent to the front area of the waistband;

wherein a portion of the extended zipper is positioned adjacent to the short zipper such that both the portion of the extended zipper and the short zipper are located underneath a flap.

2. The article of clothing of claim 1 wherein the waistband has an opening that is adapted to be detachably connected.

3. The article of clothing of claim 2 further comprising a means for detachably connecting the waistband.

4. The article of clothing of claim 3 wherein the means for detachably connecting the waistband is a snap fastener.

5. The article of clothing of claim 1 wherein each of the pair of leg members comprises a stitching adapted to permit the distal ends of the leg members to be shortened without excessive fraying.

* * * * *